US010026362B2

(12) United States Patent
Li et al.

(10) Patent No.: US 10,026,362 B2
(45) Date of Patent: Jul. 17, 2018

(54) ORGANIC LIGHT-EMITTING DISPLAY PANEL AND DRIVING METHOD THEREOF, AND ORGANIC LIGHT-EMITTING DISPLAY DEVICE

(71) Applicant: SHANGHAI TIANMA AM-OLED CO., LTD., Shanghai (CN)

(72) Inventors: Yue Li, Shanghai (CN); Gang Liu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/619,352

(22) Filed: Jun. 9, 2017

(65) Prior Publication Data

US 2017/0278462 A1 Sep. 28, 2017

(30) Foreign Application Priority Data

Jan. 19, 2017 (CN) ..... 2017 1 0038196

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0819* (2013.01); *G09G 2300/0871* (2013.01); *G09G 2310/0278* (2013.01); *G09G 2320/0233* (2013.01); *G09G 2320/045* (2013.01); *G09G 2320/064* (2013.01)

(58) Field of Classification Search
CPC ..... G09G 3/3399; G09G 3/3266; G09G 2300/0891; G09G 2300/0871
See application file for complete search history.

(56) References Cited

U.S. PATENT DOCUMENTS

2006/0208971 A1* 9/2006 Deane ..... G09G 3/3233 345/76
2006/0256048 A1* 11/2006 Fish ..... G09G 3/3233 345/81
2010/0039458 A1* 2/2010 Nathan ..... G09G 3/3233 345/698
2010/0295861 A1* 11/2010 Somerville ..... G09G 3/3216 345/545
2011/0227505 A1* 9/2011 Park ..... H05B 33/0896 315/297

(Continued)

*Primary Examiner* — Ricardo L Osorio
(74) *Attorney, Agent, or Firm* — Alston & Bird LLP

(57) ABSTRACT

The present application discloses an organic light-emitting display panel, and a driving method for the display. The organic light-emitting display panel comprises a plurality of pixel driving circuits, each of the pixel driving circuits comprises a first voltage terminal, a second voltage terminal, a scanning signal terminal, a data signal terminal, a first control signal terminal, a second control signal terminal, a potential collecting terminal, a driving module, an organic light-emitting device, a luminance control module, a data write module, and a potential collecting module. The driving module is configured to drive the organic light-emitting device to emit light under control of the control terminal based on voltage provided by the first voltage terminal. The method therefore mitigates a threshold voltage drift in advanced organic light-emitting display panel technology.

15 Claims, 8 Drawing Sheets

(56) References Cited

U.S. PATENT DOCUMENTS

| | | | | |
|---|---|---|---|---|
| 2013/0088482 | A1* | 4/2013 | Nathan | G09G 3/3233 345/212 |
| 2016/0189610 | A1* | 6/2016 | Xiao | G09G 3/3233 345/77 |
| 2017/0162121 | A1* | 6/2017 | Yang | G09G 3/3266 |
| 2017/0221419 | A1* | 8/2017 | Xiang | G09G 3/3258 |
| 2017/0249898 | A1* | 8/2017 | Ma | G09G 3/3233 |

* cited by examiner

ORGANIC LIGHT-EMITTING DISPLAY PANEL AND DRIVING METHOD THEREOF, AND ORGANIC LIGHT-EMITTING DISPLAY DEVICE

CROSS-REFERENCE TO RELATED APPLICATION

This application is related to and claims priority from Chinese Patent Application No. CN201710038196.7, filed on Jan. 19, 2017, entitled "Organic Light-Emitting Display Panel and Driving Method Thereof, and Organic Light-Emitting Display Device," the entire disclosure of which is hereby incorporated by reference for all purposes.

TECHNICAL FIELD

The present application relates to the technical field of display, particularly to the technical field of organic light emission display, and more particularly to an organic light-emitting display panel and a driving method thereof, and an organic light-emitting display device.

BACKGROUND

An organic light-emitting display (OLED) performs display using a self-lighting emission property of an organic semiconductor material. As compared with a liquid crystal display, the organic light-emitting display does not need backlight and may effectively reduce a thickness of a display screen. Usually, in OLED a pixel array comprised of sub-pixels is disposed in a display region of the organic light-emitting display. Each sub-pixel comprises an organic light-emitting diode, which is driven by a pixel driving circuit to emit light.

A current type of pixel driving circuit may comprise a driving transistor, and the driving transistor provides light-emitting current to the organic light-emitting diode under control of a light-emitting control signal. Usually, the light-emitting current of the organic light-emitting diode is relevant to a threshold voltage Vth of the driving transistor, but the threshold voltage Vth of the driving transistor undergoes drift (namely, "threshold drift") due to factors such as process or aging after long-term use, so the luminance of the organic light-emitting diode exhibits a poor accuracy. Furthermore, an amount of drift of the threshold voltage of different organic light-emitting diodes might be different from one another, and display luminance of the sub-pixels deviates apparently so that display uniformity of images is undesirable.

SUMMARY

The present application provides an organic light-emitting display panel and a driving method thereof, and an organic light-emitting display device, in order to solve the technical problem mentioned above.

To achieve the above object, in a first aspect, the present application provides an organic light-emitting display panel, comprising a plurality of pixel driving circuits arranged in a matrix. Each of the pixel driving circuits comprises a first voltage terminal, a second voltage terminal, a scanning signal terminal, a data signal terminal, a first control signal terminal, a second control signal terminal, a potential collecting terminal, a driving module, an organic light-emitting device, a luminance control module, a data write module and a potential collecting module; the driving module comprises a first terminal, a second terminal and a control terminal, and the first terminal of the driving module is electrically connected with a first electrode of the organic light-emitting device, the second terminal of the driving module is electrically connected with the first voltage terminal, the driving module is configured to drive the organic light-emitting device to emit light under control of the control terminal and based on voltage provided by the first voltage terminal; a second electrode of the organic light-emitting device is electrically connected with the second voltage terminal; the luminance control module comprises a first terminal, a second terminal and a control terminal, the first terminal of the luminance control module is electrically connected with the first terminal of the driving module, the second terminal of the luminance control module is electrically connected with the control terminal of the driving module, the control terminal of the luminance control module is electrically connected with the first control signal terminal, the luminance control module is configured to control the luminance of the organic light-emitting device by controlling the potential of the first terminal and the control terminal of the driving module; the data write module is electrically connected with the scanning signal terminal, the control terminal of the driving module, and the data signal terminal, and the data write module is configured to write the signal of the data signal terminal into the control terminal of the driving module under the control of the scanning signal terminal; the potential collecting module is electrically connected with the second control signal terminal, the potential collecting terminal, the first terminal of the driving module, and the potential collecting module is configured to collect the potential of the first terminal of the driving module.

In a second aspect, the present application provides a driving method applied to the organic light-emitting display panel. The driving method comprises: in a first phase, providing a first level signal to the first control signal terminal, providing a second level signal to the second control signal terminal, and the luminance control module initializing the control terminal and first terminal of the driving module to have an identical potential; in a second phase, providing a first level signal to the scanning signal terminal, providing a second level signal to the first control signal terminal, providing a second level signal to the second control signal terminal, providing a first signal to the data signal terminal, the data write module writing the first signal into the control terminal of the driving module, and the first voltage terminal charging the first terminal of the driving module; in a third phase, providing a second level signal to the first control signal terminal and the second control signal terminal, providing a data signal to the data signal terminal, and the potential of the control terminal of the driving module rising or falling; in a fourth phase, providing a first level signal to the scanning signal terminal and data signal terminal, providing a luminance control signal to the first control signal terminal Ctrl1, providing a second level signal to the second control signal terminal, the organic light-emitting device emits light according to a potential difference between the first terminal of the driving module and the control terminal of the driving module, the luminance control signal is used to control the luminance of light emitted by the organic light-emitting device by controlling light-emitting time of the organic light-emitting device.

In a third aspect, the present application provides an organic light-emitting display device comprising the organic light-emitting display panel.

The organic light-emitting display panel and the driving method thereof, and the organic light-emitting display device according to the present application comprise a plurality of pixel driving circuits arranged in a matrix, each of the pixel driving circuits comprises a driving module, an organic light-emitting device, a luminance control module, a data write module and a potential collecting module, wherein the driving module drives the organic light-emitting device to emit light under control of the control terminal and based on voltage provided by the first voltage terminal, the luminance control module controls the luminance of the organic light-emitting device by controlling the potential of the first terminal and the control terminal of the driving module, the data write module writes the signal of the data signal terminal into the control terminal of the driving module under the control of the scanning signal terminal, the potential collecting module is configured to collect the potential of the first terminal of the driving module, and the luminance control module drives the gate and the first electrode of the driving transistor to the same potential according to the luminance control signal, which avoids the threshold voltage drift of the driving transistor, and extends the service life of the driving transistor. Meanwhile, it is also feasible to change the light-emitting time of the organic light-emitting device by using the luminance control signal and thereby control the luminance of light emitted by the organic light-emitting device.

BRIEF DESCRIPTION OF THE DRAWINGS

Other features, objects, and advantages of the present application will become more apparent upon reading of the following detailed description of the non-limiting embodiments with reference to the accompanying drawings, in which.

DETAILED DESCRIPTION OF EMBODIMENTS

The present application will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should also be noted that the embodiments in the present application and the features in the embodiments may be combined with each other on a non-conflict basis. The present application will be described below in detail with reference to the accompanying drawings and in combination with the embodiments.

Figure 1:
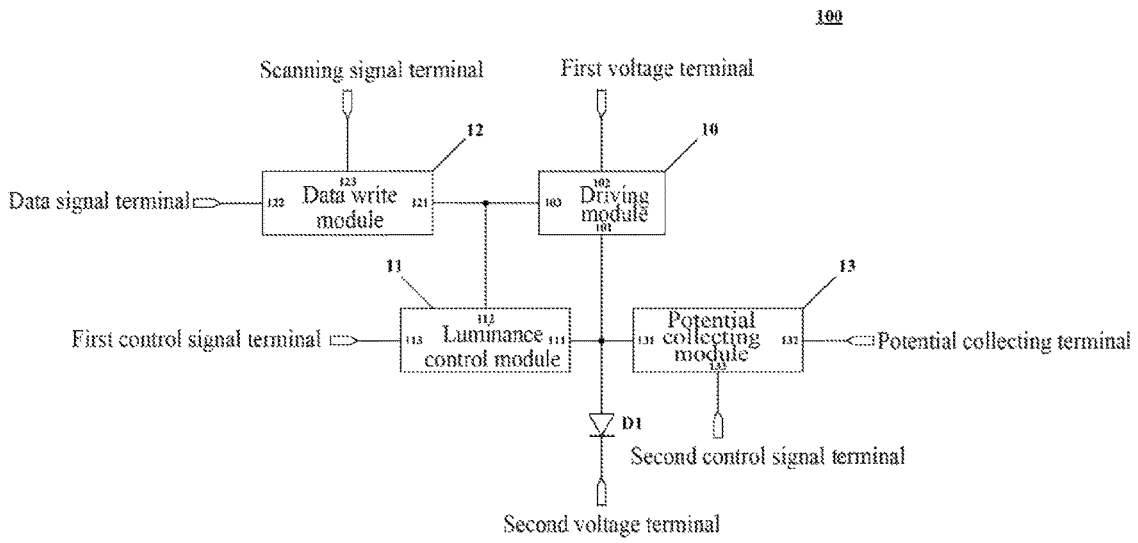
FIG. 1 is a schematic view of a pixel driving circuit in an organic light-emitting display panel according to an embodiment of the present application.

Referring to FIG. 1, it is a structural schematic view of an embodiment of a pixel driving circuit in an organic light-emitting display panel according to the present application. In the present embodiment, the organic light-emitting display panel comprises a plurality of pixel driving circuits 100 arranged in an array.

As shown in FIG. 1, each pixel driving circuit 100 comprises a first voltage terminal Pvdd, a second voltage terminal Pvee, a scanning signal terminal Scan, a data signal terminal Vdata, a first control signal terminal Ctrl1, a second control signal terminal Ctrl2, a potential collecting terminal Col, a driving module 10, an organic light-emitting device D1, a luminance control module 11, a data write module 12 and a potential collecting module 13, wherein the organic light-emitting device D1 may be an organic light-emitting diode, which is identified by a circuit symbol of the organic light-emitting diode in FIG. 1.

The driving module 10 comprises a first terminal 101, a second terminal 102 and a control terminal 103, and the first terminal 101 of the driving module 10 is electrically connected with a first electrode of the organic light-emitting device D1. The second terminal 102 of the driving module 10 is electrically connected with the first voltage terminal Pvdd. The driving module 10 is configured to drive the organic light-emitting device D1 to emit light under control of the control terminal 103 and based on voltage provided by the first voltage terminal Pvdd.

A second electrode of the organic light-emitting device D1 is electrically connected with the second voltage terminal Pvee.

The luminance control module 11 comprises a first terminal 111, a second terminal 112 and a control terminal 113, and the first terminal 111 of the luminance control module 11 is electrically connected with the first terminal 101 of the driving module 10. The second terminal 112 of the luminance control module 11 is electrically connected with the control terminal 103 of the driving module 10. The control terminal 113 of the luminance control module 11 is electrically connected with the first control signal terminal Ctrl1. The luminance control module 11 is configured to control the luminance of the organic light-emitting device D1 by controlling the potential of the first terminal 101 and the control terminal 103 of the driving module 10.

The data write module 12 is electrically connected with the scanning signal terminal Scan, the control terminal 103 of the driving module 10, and the data signal terminal Vdata. The data write module 12 is configured to write the signal of the data signal terminal Vdata into the control terminal 103 of the driving module 10 under the control of the scanning signal terminal Scan.

Figure 2:
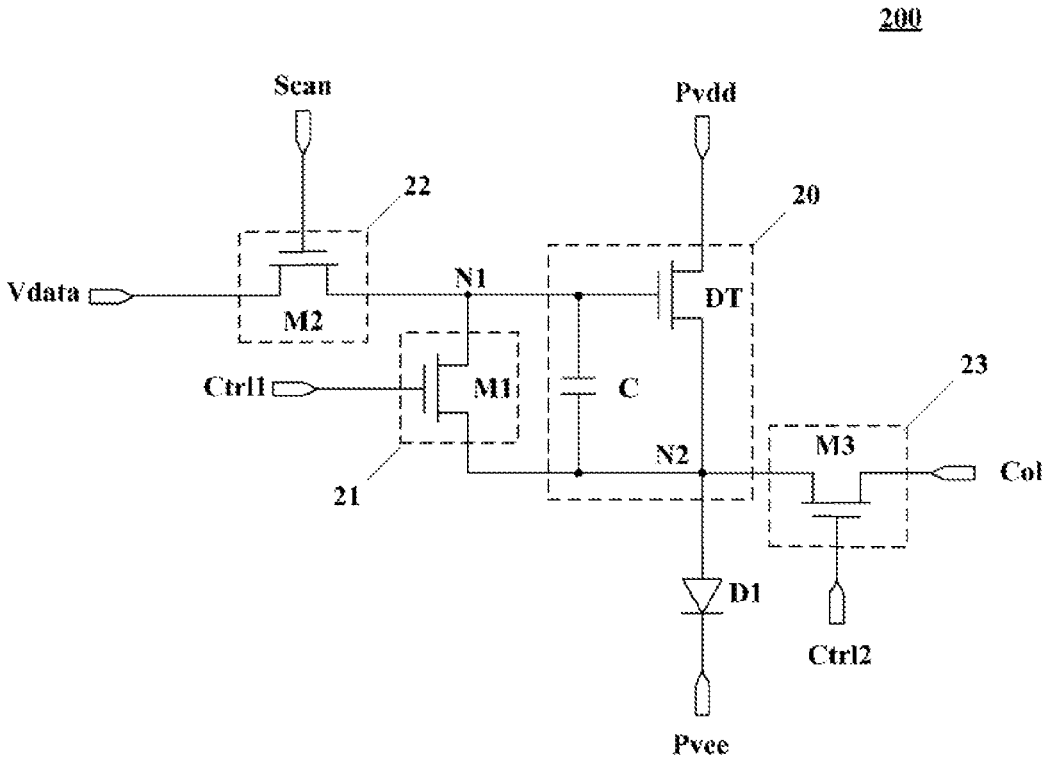
FIG. 2 is an exemplary circuit diagram of the pixel driving circuit shown in FIG. 1.

Referring to FIG. 1 and FIG. 2, the potential collecting module 13 is electrically connected with the second control signal terminal Ctrl2, the potential collecting terminal Col and the first terminal 101 of the driving module 10. The potential collecting module 14 is configured to collect the potential of the first terminal 101 of the driving module 10.

In the aforesaid pixel driving circuit 100, the luminance control module 11, under control of the first control signal terminal Ctrl1, may initialize the potential of the control terminal 103 of the driving module 10 and the first terminal 101 of the driving module 10. That is to say, the luminance control module 11 may simultaneously initialize the potential of the control terminal 103 and first terminal 101 of the driving module 10. Optionally, the luminance control module 11 may initialize the potential of the control terminal 103 and first terminal 101 of the driving module 10 to have an identical potential.

In the present embodiment, the driving module 10 is turned on or turned off by the control of a voltage difference of the control terminal 103 and the first terminal 101 of the driving module 10. The driving module 10 is in an ON state, the first voltage terminal Pvdd may charge the first terminal 101 of the driving module 10 until the voltage difference of the control terminal 103 and first terminal 101 of the driving module 10 reaches an OFF state. The potential collecting module 13 is turned on under control of the second control signal terminal Ctrl2 so that the potential collecting terminal Col collects the potential of the first terminal 101 of the driving module 10. As such, a threshold voltage of the driving module 10 may be determined by a potential difference of the control terminal 103 and first terminal 101 of the driving module 10. Therefore, the pixel driving circuit 100 in the embodiment of the present application may grasp the threshold voltage of the driving module 10, then adjust the data signal terminal Vdata according to the threshold voltage, and control electrical current passing through the organic light-emitting device D1 to control the luminance of the organic light-emitting device D1.

The pixel driving circuit 100 may have many types of different circuit structures. Reference is made to FIG. 2 which shows a specific circuit structural diagram of the pixel driving circuit shown in FIG. 1.

As shown in FIG. 2, the pixel driving circuit 200 comprises a driving module 20, a luminance control module 21, a data write module 22 and a potential collecting module 23. The driving module 20, the luminance control module 21, the data write module 22 and the potential collecting module 23 may respectively be the driving module 10, luminance control module 11, data write module 12 and potential collecting module 13 in the pixel driving circuit 100 shown in FIG. 1.

In the present embodiment, the driving module 20 comprises a driving transistor DT and a capacitor C, wherein a gate of the driving transistor DT is a control terminal (namely, N1 node shown in FIG. 2) of the driving module 20, and a first electrode and a second electrode of the driving transistor DT are a first terminal (namely, N2 node shown in FIG. 2) and a second terminal of the driving module 20 respectively. Both terminals of the capacitor C are electrically connected with the gate and the first electrode of the driving transistor DT respectively. The first electrode of the driving transistor DT is electrically connected with the first electrode of the organic light-emitting device D1. The second electrode of the driving transistor DT is electrically connected with the first voltage terminal Pvdd. Here, the first electrode of the organic light-emitting device D1 may be an anode, and the second electrode of the organic light-emitting device D1 may be a cathode.

The luminance control module 21 comprises a first transistor M1. A first electrode of the first transistor M1 is electrically connected with the first electrode of the driving transistor DT. A second electrode of the first transistor M1 is electrically connected with the gate of the driving transistor DT. The gate of the first transistor M1 is electrically connected with the first control signal terminal Ctrl1.

The data write module 22 comprises a second transistor M2. A first electrode of the second transistor M2 is electrically connected with the gate of the driving transistor DT. A second electrode of the second transistor M2 is electrically connected with the data signal terminal Vdata. A gate of the second transistor M2 is electrically connected with the scanning signal terminal Scan.

The potential collecting module 23 comprises a third transistor M3. A first electrode of the third transistor M3 is electrically connected with the first electrode of the driving transistor DT. A second electrode of the third transistor M3 is electrically connected with the potential collecting terminal Col. A gate of the third transistor M3 is electrically connected with the second control signal terminal Ctrl2.

In the present embodiment, the gate and first electrode of the driving transistor DT are electrically connected with the second electrode and the first electrode of the first transistor M1. When the first transistor M1 is turned on, the gate and first electrode of the driving transistor DT have equal potential. The gate and first electrode of the driving transistor DT are further respectively connected with two electrode plates of the capacitor C so that when the first transistor M1 is in an OFF state, the capacitor C may maintain the potential difference (namely, a voltage between the gate and first electrode of the driving transistor DT) between the gate and first electrode of the driving transistor DT. When the first voltage terminal Pvdd charges the first electrode of the driving transistor DT until the difference between the potential of the gate of the driving transistor DT and the potential of the first electrode of the driving transistor DT is equal to the threshold voltage of the driving transistor DT, the driving transistor DT changes from the ON state to the OFF state. At this time, the third transistor M3 is turned on under control of the second control signal terminal Ctrl2, and the potential collecting terminal Col records the potential of the first electrode of the driving transistor DT. After other devices of the organic light-emitting display panel obtain the potential of the first electrode of the driving transistor DT, the threshold voltage of the driving transistor DT may be obtained by calculating according to the signal received by the data signal terminal Vdata at this time. During subsequent control of the luminance of the organic light-emitting device D1, the voltage of the signal received by the data signal terminal Vdata may be changed purposefully to control the electrical current flowing through the organic light-emitting device D1 and thereby control the luminance of light emitted by the organic light-emitting device D1.

In the aforesaid pixel driving circuit 200, the first electrode of the first transistor M1 in the luminance control module 21 is electrically connected with the first electrode of the driving transistor DT. The second electrode of the first transistor M1 is electrically connected with the gate of the driving transistor DT. The first electrode of the second transistor M2 in the data write module 12 is electrically connected with the gate of the driving transistor DT. When the first control signal terminal Ctrl1 controls the first transistor M1 to turn on and the scanning signal terminal Scan controls the second transistor M2 to turn on, the data signal terminal Vdata achieves the initialization for the gate and first electrode of the driving transistor DT. It can be seen that the pixel driving circuit 200 does not need to employ an initialization signal line, reduces the number of signal lines of the organic light-emitting display panel, facilitates increase of an area for evaporating an organic light-emitting material, and may further improve the aperture ratio and resolution.

Figure 3:
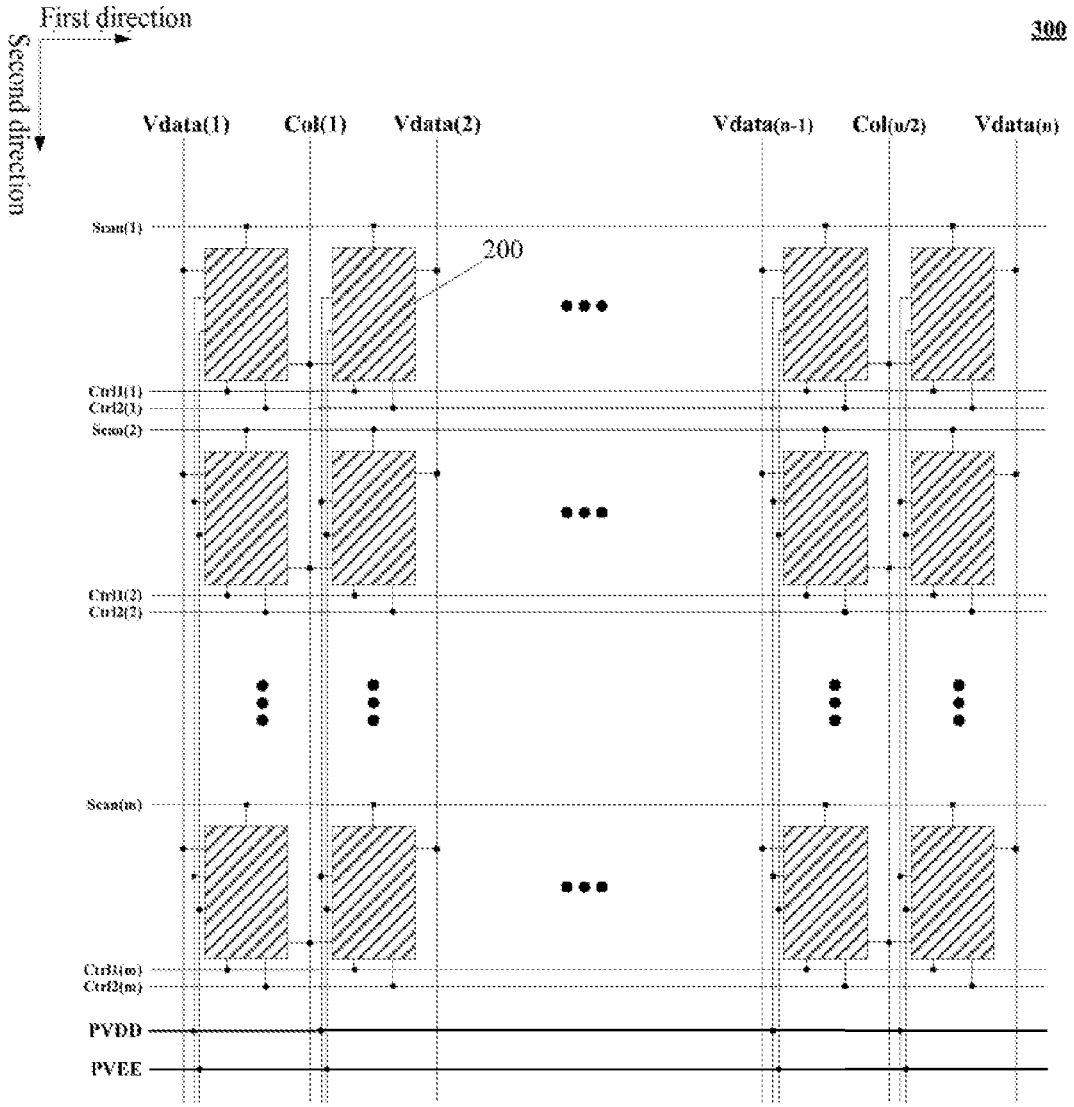
FIG. 3 is a schematic view of an organic light-emitting display panel of the pixel driving circuit in an embodiment shown in FIG. 2.

FIG. 3 shows a plan view of an organic light-emitting display panel of the pixel driving circuit according to the embodiment shown in FIG. 2. As shown in FIG. 3, the organic light-emitting display panel 300 comprises a plurality of pixel driving circuits 200 arranged in an array, for example, a plurality of pixel driving circuits 200 arranged in a matrix array in a first direction and a second direction as shown in FIG. 3, wherein the first direction is a row direction of the matrix array, and the second direction is a column direction of the matrix array. Each pixel driving circuit 200 may have a circuit structure shown in FIG. 2, which will not be detailed here.

Furthermore, as shown in FIG. 3, the organic light-emitting display panel 300 further comprise a plurality of first control signal lines Ctrl1(1), Ctrl1(2), . . . Ctrl(m), a plurality of second control signal lines Ctrl2(1), Ctrl2(2), . . . Ctrl2(*m*), a plurality of data lines Vdata(1), Vdata(1), . . . Vdata(n−1) and Vdata(n), a plurality of scanning lines Scan(1), Scan(2), . . . Scan(m), a plurality of potential collecting lines Col(1), . . . Col(n), a first voltage signal line PVDD and a second voltage signal line PVEE, wherein m and n are positive integers and n is an even number.

Each of the first control signal lines Ctrl1(1), Ctrl1(2), . . . Ctrl1(*m*) is electrically connected with the first control signal terminal Ctrl1 in one row of pixel driving circuits 200. Each of the second control signal lines Ctrl2(1), Ctrl2(2), . . . Ctrl2(*m*) is electrically connected with the second control signal terminal Ctrl2 in one row of pixel driving circuits 200. Each of the data lines Vdata(1), Vdata (2), . . . Vdata(n−1) and Vdata(n) is electrically connected with the data signal terminal Vdata in one column of pixel driving circuits 200. Each of the scanning lines Scan(1), Scan(2), . . . Scan(m) is electrically connected with the scanning signal terminal Scan in one row of pixel driving circuit 200. Each of the potential collecting lines Col(1), . . . Col(n) is electrically connected with the potential collecting terminal Col. The first voltage terminal Pvdd of each of the pixel driving circuits 200 is electrically connected with the first voltage signal line PVDD. The second voltage terminal Pvee of each of the pixel driving circuits is electrically connected with the second voltage signal line PVEE.

Figure 4:
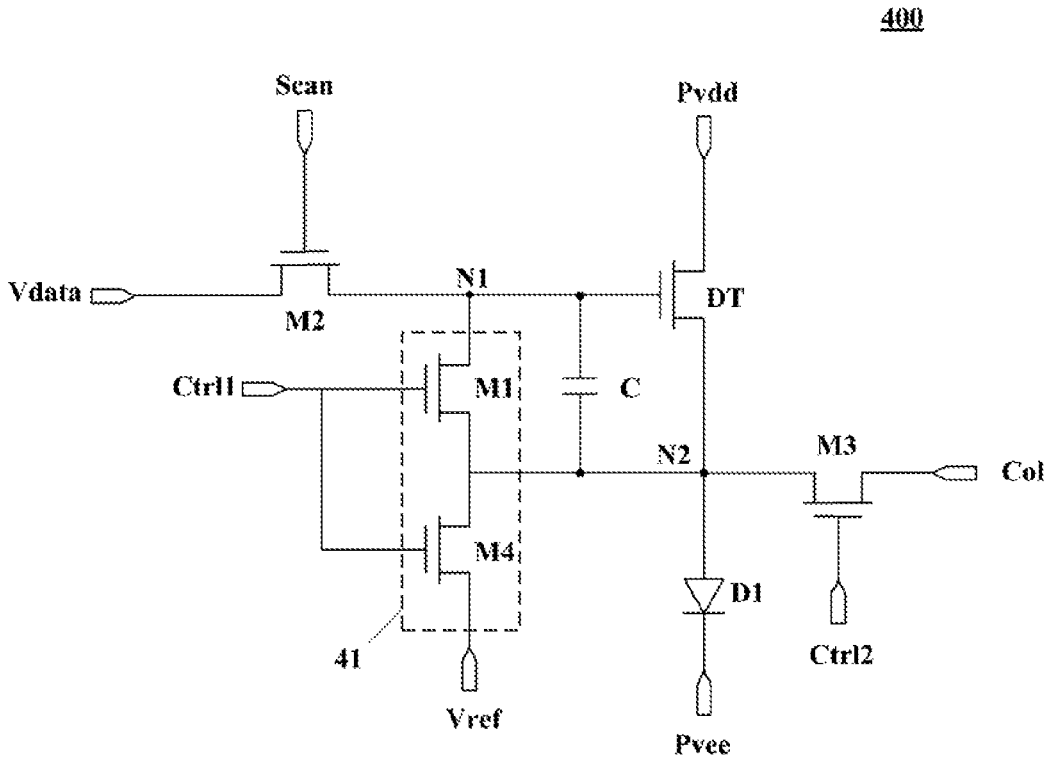
FIG. 4 is another specific circuit diagram of the pixel driving circuit shown in FIG. 1.

Reference is made to FIG. 4 which shows another specific circuit diagram of the pixel driving circuit shown in FIG. 1.

As shown in FIG. 4, on the basis of the pixel driving circuit 200 shown in FIG. 2, the pixel driving circuit 400 in the present embodiment further comprise a reference voltage signal terminal Vref. The luminance control module 41 includes, in addition to the first transistor M1, a fourth transistor M4. A gate of the fourth transistor M4 is electrically connected with the first control signal terminal Ctrl1, a first electrode of the fourth transistor M4 is electrically connected with the reference voltage signal terminal Vref, and a second electrode of the fourth transistor M4 is electrically connected with the first electrode of the driving transistor DT.

In the present embodiment, gates of the first transistor M1 and fourth transistor M4 are both electrically connected with the first control signal terminal Ctrl, so the first transistor M1 and fourth transistor M4 are simultaneously turned on or simultaneously turned off. The potential of the gate and first electrode of the driving transistor DT may be provided by the reference voltage signal terminal Vref. That is, when the circuit is initialized, the reference voltage signal terminal Vref controls the first transistor M1 and fourth transistor M4 to turn on, thereby transmitting the signal of the reference voltage signal terminal Vref to the gate and first electrode of the driving transistor DT.

As compared with the embodiment shown in FIG. 2, the present embodiment is added with the reference voltage signal terminal Vref, the data signal terminal Vdata does not need to provide initialization signal to the driving transistor DT, the number of times of changes of the potential of the signal of the data signal terminal Vdata is decreased, and the complexity of the signal of the data signal terminal Vdata is reduced. Since the signal of the data signal terminal Vdata is provided by an integrated circuit IC, the pixel driving circuit of the present embodiment may reduce a load of the integrated circuit.

Furthermore, the present application further provides an organic light-emitting display panel including the pixel driving circuit 400 shown in FIG. 4. On the basis of the organic light-emitting display panel shown in FIG. 3, the organic light-emitting display panel further includes at least one reference voltage signal line, and each reference voltage signal line is electrically connected with the reference voltage signal terminal Vref of at least two pixel driving circuit 400. Optionally, at least two pixel driving circuits electrically connected with the same reference voltage signal line may be located in the same row or the same column, or located in different rows and different columns.

Figure 5:
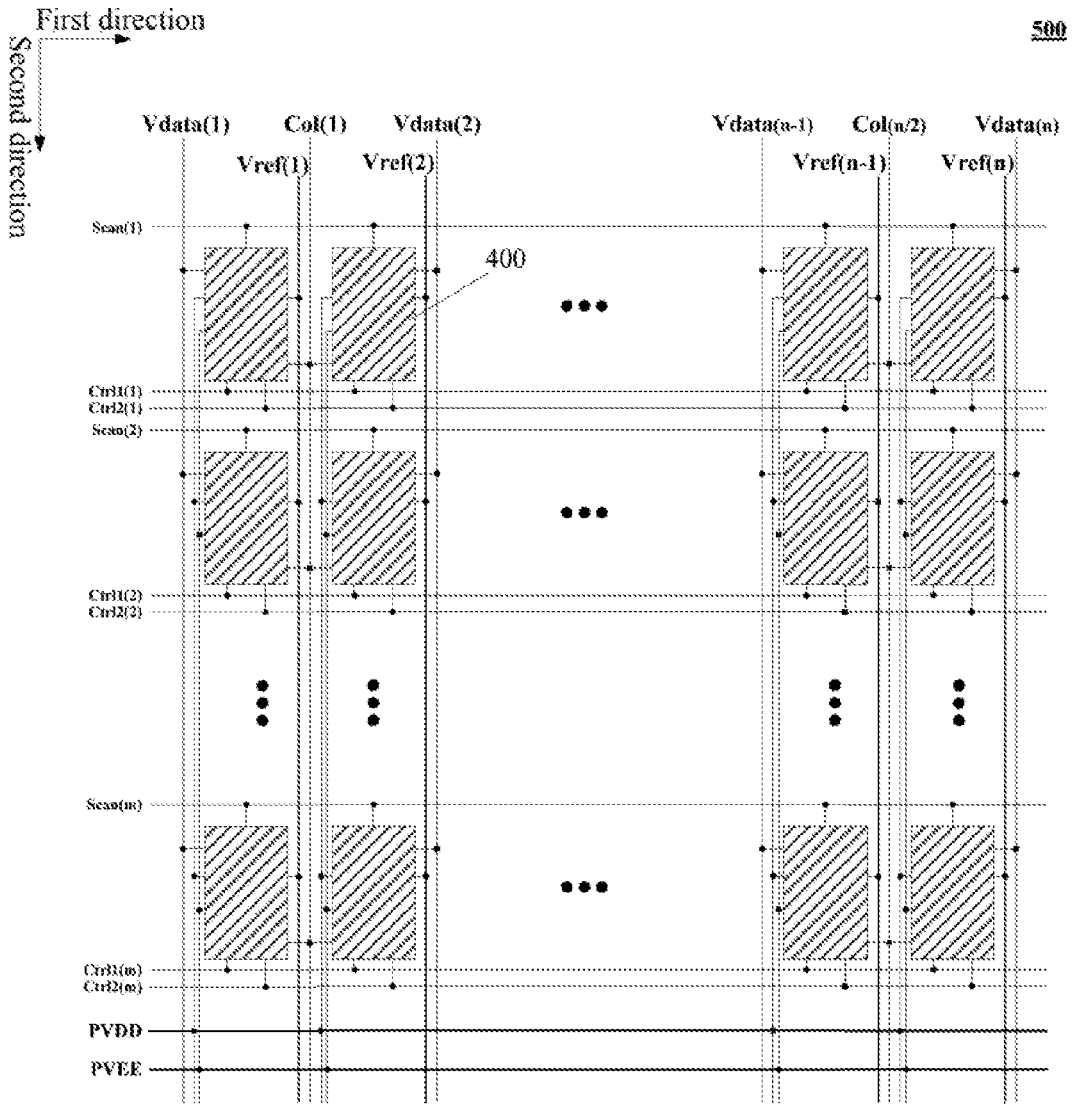
FIG. 5 is a schematic view of the organic light-emitting display panel of the pixel driving circuit of an embodiment shown in FIG. 4.

Referring to FIG. 5, FIG. 5 shows a structural schematic view of an embodiment of the organic light-emitting display panel of the pixel driving circuit shown in FIG. 4. As shown in FIG. 5, on the basis of the organic light-emitting display panel 300 shown in FIG. 3, the organic light-emitting display panel 500 in the present embodiment further comprises reference voltage signal lines Vref(1), Vref(2), . . . Vref(n−1) and Vref(n). Each of the reference voltage signal lines Vref(1), Vref(2), . . . Vref(n−1) and Vref(n) is electrically connected with the reference voltage signal terminal Vref in one column of pixel driving circuits 400. In other implementation modes, reference voltage signal terminals of all pixel driving circuits in the organic light-emitting display panel may be connected to the same reference voltage signal line, namely, the potential of the driving transistors DT in all pixel driving circuits on the organic light-emitting display panel is initialized through the same reference voltage signal line.

It needs to be appreciated that in FIG. 3 and FIG. 5, every two adjacent columns of pixel driving circuits on the organic light-emitting display panel in the first direction share one potential collecting line to reduce line complexity.

The organic light-emitting display panel shown in FIG. 5 uses the reference voltage signal line to initialize the potential of the driving transistor DT in the pixel driving circuit, and data lines does not have to transmit the initialization signal so that the number of times of changes of the voltage values of signals on the data lines is reduced, and stability of signals transmitted through the data lines is enhanced.

It should be appreciated that the first transistor M1, second transistor M2, third transistor M3 and fourth transistor M4 and the driving transistor DT in the above embodiments may all be a N-type transistor or P-type transistor. When the driving transistor DT is the N-type transistor, its threshold voltage Vth>0; when the driving transistor is the P-type transistor, its threshold voltage Vth<0.

The present application further provides a method of driving embodiments of the organic light-emitting display panel. The driving method comprises: in a first phase, providing a first level signal to the first control signal terminal Ctrl1, providing a second level signal to the second control signal terminal Ctrl2, and the luminance control module initializing the control terminal and first terminal of the driving module to have an identical potential. In a second phase, providing a first level signal to the scanning signal terminal Scan, providing a second level signal to the first control signal terminal Ctrl1, providing a second level signal to the second control signal terminal Ctrl2, providing a first signal to the data signal terminal Vdata, the data write module writing the first signal into the control terminal of the driving module, and the first voltage terminal Pvdd charging the first terminal of the driving module. In a third phase, providing a second level signal to the first control signal terminal Ctrl1 and the second control signal terminal Ctrl2, providing a data signal to the data signal terminal Vdata, and the potential of the control terminal of the driving module rising or falling. In a fourth phase, providing a first level signal to the scanning signal terminal Scan and data signal terminal Vdata, providing a luminance control signal to the first control signal terminal Ctrl1, providing a second level signal to the second control signal terminal Ctrl2, the organic light-emitting device emits light according to a potential difference between the first terminal of the driving module and the control terminal of the driving module. The luminance control signal is used to control the luminance of light emitted by the organic light-emitting device D1 by controlling light-emitting time of the organic light-emitting device.

Figure 6:
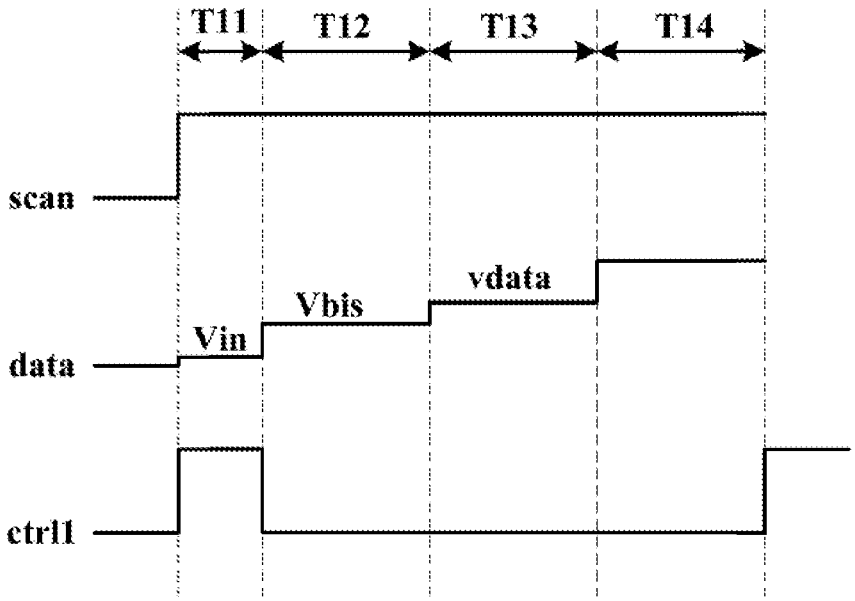
FIG. 6 is a working time-sequence diagram of the pixel driving circuit shown in FIG. 2.
Figure 7:
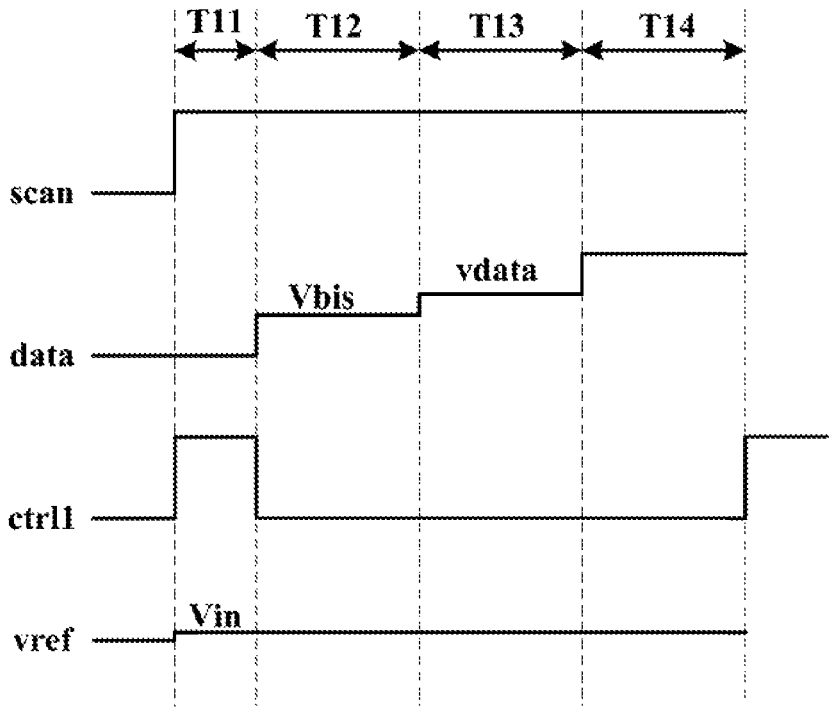
FIG. 7 is a working time-sequence diagram of the pixel driving circuit shown in FIG. 4.

The working principle of the driving method is further described in conjunction with FIG. 6 and FIG. 7 by way of an example in which the first transistor M1, second transistor M2, third transistor M3, fourth transistor M4 and the driving transistor DT in the above embodiments all are N-type transistors, and the first level signal in the above driving method is a high level signal and the second level signal is a low level signal. Scan, data, ctrl1, ctrl2, col and vref respectively represent signals respectively provided to the scanning signal terminal Scan, data signal terminal Vdata, first control signal terminal Ctrl1, second control signal terminal Ctrl2, the potential collecting terminal Col, and the reference voltage signal terminal Vref. The high level and low level only represent a relative relationship of levels and are not particularly defined as a certain level signal. The high level signal may be a signal turning on the first through fourth transistors, and the low level signal may be a signal turning off the first through fourth transistors.

Reference is made to FIG. 6 which shows a working time-sequence diagram of the pixel driving circuit 200 shown in FIG. 2.

As shown in FIG. 6, in the first phase T11, the first level signal is provided to the first control signal terminal Ctrl1 and the scanning signal terminal Scan. The initialized voltage signal Vin is provided to the data signal terminal Vdata, the data write module transmits the initialized voltage signal to the luminance control module, and the luminance control module initializes the control terminal and first terminal of the driving module to have an identical potential. Specifically, the first phase T11 is an initialization phase, the first transistor M1 and second transistor M2 in the pixel driving circuit 200 are turned on, and the initialized voltage signal Vin input by the data signal terminal Vdata is transmitted to nodes N1 and N2. The luminance control module initializes the gate and the first electrode of the driving transistor DT to have an identical potential. At this time, the potential of each of the nodes N1 and D2 is Vin, the voltage value of the initialization voltage signal Vin is smaller, a difference between it and the voltage value of the signal at the second voltage terminal Pvee is smaller than a turn-on voltage of the organic light-emitting device D1, and the organic light-emitting device D1 does not emit light.

In the second phase T12, the first level signal is provided to the scanning signal terminal Scan, the second level signal is provided to the first control signal terminal Ctrl1, the second level signal is provided to the second control signal terminal Ctrl2, the first signal Vbis is provided to the data signal terminal Vdata, the data write module writes the first signal Vbis into the gate of the driving transistor DT, and the first voltage terminal Pvdd charges the first electrode of the driving transistor DT. The capacitor C stores the voltage between the gate and first electrode of the driving transistor DT. Specifically, the second phase T12 is a voltage biasing phase. At this time, the first signal Vbis is slightly smaller than the threshold voltage Vth of the driving transistor DT, the potential at both terminals of the capacitor C is Vbis−Vin<Vth, the driving transistor DT is not ON, and the organic light-emitting device D1 does not emit light. Usually, the voltage value of the initialization voltage signal is lower than the voltage value of the first signal, and the difference between the voltage value of the initialization voltage signal and the voltage of the signal of the second voltage terminal Pvee is smaller than the ON voltage of the organic light-emitting device D1.

In the third phase T13, the second level signal is provided to the first control signal terminal Ctrl1, the first level signal is provided to the scanning signal terminal Scan, the data signal vdata is provided to the data signal terminal Vdata, and the data write module writes the data signal vdata into the gate of the driving transistor DT. The potential of the gate of the driving transistor changes, and the signal of the gate of the driving transistor changes from the first signal Vbis to the data signal vdata. Specifically speaking, the third phase T13 is a data write phase, the second transistor M2 is turned on and transmits the data signal vdata to the first node N1, furthermore vdata−Vin<Vth, and the driving transistor DT is not turned on. An amount of change of the potential of one terminal (the first node N1) of the capacitor C is vdata−Vbis, and the other end (the second node N2) of the capacitor C is in a suspended state. Under the coupling action of the capacitor C and a voltage division action of the organic light-emitting device D1, the amount of change of the potential of the second node N2 is (C01/(C01+Coled))×(vdata−Vbis), namely, the potential of the second node N2 becomes Vin+(C01/(C01+Coled))×(Vdata−Vbis), wherein C01 and Coled respectively represent a capacitance value of the capacitor C and the organic light-emitting device D1. Optionally, Vdata−Vbis>0.

In the fourth phase, the first level signal is provided to the scanning signal terminal Scan and the data signal terminal Vdata, the luminance control signal is provided to the first control signal terminal Ctrl1, the second level signal is provided to the second control signal terminal Ctrl2, and the organic light-emitting device D1 emits light according to a potential difference between the first terminal of the driving module and the control terminal of the driving module. The luminance control signal is used to control the luminance of light emitted by the original light-emitting device D1 by controlling light-emitting time of the organic light-emitting device. Specifically, the fourth phase T14 is a light-emitting phase. In the light-emitting phase, the luminance control signal is a low level, and the first transistor M1 is not ON. When the light-emitting phase ends, the luminance control signal is a high level, the first transistor M1 is ON so that the gate and first electrode of the driving transistor DT have the same potential, the driving transistor DT is not ON, and the organic light-emitting device D1 does not emit light. There is no voltage difference between the gate and the first electrode of the driving transistor DT, which avoids the threshold voltage drift of the driving transistor DT, and extends the service life of the driving transistor DT and capacitor C. It is further feasible to set the time when the luminance control signal changes from the low level to the high level. The earlier the high level of the luminance control signal arrives, the shorter the light-emitting time of the organic light-emitting device D1 is, and the lower the luminance is; the later the high level of the luminance control signal arrives, the longer the light-emitting time of the organic light-emitting device D1 is, and the higher the luminance is.

In this way, the pixel driving circuit 200 shown in FIG. 2 can avoid the threshold voltage drift of the driving transistor, the circuit structure is simple, the number of signal lines is smaller, and the design of a high-resolution display panel is facilitated.

Referring to FIG. 7, FIG. 7 shows a working time-sequence diagram of the pixel driving circuit 400 shown in FIG. 4.

As shown in FIG. 7, in a first phase T21, the first level signal is provided to the first control signal terminal Ctrl1, the first signal is provided to the data signal terminal Vdata, the second level signal is provided to the scanning signal terminal Scan, and the reference voltage signal vref is provide to the reference voltage signal terminal Vref. At this time, the first transistor M1 and fourth transistor M4 are ON, and the luminance control module transmits the reference voltage signal vref to the control terminal (the first node N1) and the first electrode (the second node N2) of the driving transistor DT. The potential of the first node N1 and the potential of the second node N1 are both vref. Specifically, the luminance control module transmits the reference voltage signal vref to the gate and first electrode of the driving transistor DT. At this time, the voltage value of the reference voltage signal vref is lower than the turn-on voltage Voled of the organic light-emitting device D1, and the organic light-emitting device D1 does not emit light.

In a second phase T22, the first level signal is provided to the scanning signal terminal Scan, the second level signal is provided to the first control signal terminal Ctrl1, and the first signal Vbis is provided to the data signal terminal Vdata. The data write module writes the first signal Vbis into the control terminal of the driving module, and the first voltage terminal Pvdd charges the first terminal of the driving module. The first signal Vbis is slightly smaller than the threshold voltage Vth of the driving transistor DT, the potential of both terminals of the capacitor C is Vbis−Vin<Vth, the driving transistor DT is not ON, and the organic light-emitting device D1 does not emit light.

In a third step T23, the second level signal is provided to the first control signal terminal Ctrl1, the first level signal is provided to the scanning signal terminal Scan, the data signal vdata is provided to the data signal terminal Vdata, and the voltage value of the first signal is lower than the voltage value of the data signal.

The data write module writes the data signal vdata into the gate of the driving transistor DT, and the signal of the gate of the driving transistor changes from the first signal Vbis to the data signal vdata. The second transistor M2 is ON and transmits the data signal vdata to the first node N1, vadata−Vin<Vth, and the driving transistor DT is not ON.

A fourth phase T24 is a light-emitting phase, and its working principle is the same as the working principle of the fourth phase T14 shown in FIG. 6.

As can be seen from FIG. 6 and FIG. 7, the pixel driving circuit 400 shown in FIG. 4 is employed, upon driving the signal of the data signal terminal Vdata only changes once and changes from Vbis to vdata. As compared with the pixel driving circuit 200 shown in FIG. 2, the pixel driving circuit effectively reduces the number of times of changes of the potential of the signal of the data signal terminal Vdata, reduces the complexity of the driving method, and facilitates enhancement of the stability of the signal transmitted through the data signal line connected with the data signal terminal.

Prior to the fourth phase to the fourth phase, the pixel driving circuit further comprises a threshold voltage obtaining phase. Specifically, the first level signal is provided to the scanning signal terminal Ctrl1 and the second control signal terminal Ctrl2. The second level signal is provided to the first control signal terminal Ctrl1. The first signal is provided to the data signal terminal Vdata, the data write module writes the first signal into the control terminal of the driving module, the driving module is ON, and the first voltage terminal Pvdd begins to charge the first terminal of the driving module. Specifically, the data write module writes the first signal into the gate of the driving transistor DT, and the first voltage terminal Pvdd charges the first electrode of the driving transistor DT. The capacitor C stores the voltage between the gate and the first electrode of the driving transistor DT. The potential collecting terminal Col collects the potential of the first electrode of the driving transistor. When the potential collected by the potential collecting terminal Col does not change any more, this indicates that at this time the voltage between the gate and the first electrode of the driving transistor DT is the threshold voltage. The differential value between the potential of the first signal and the potential collected by the potential collecting terminal Col is the threshold voltage. After the threshold voltage is obtained, the value of the data signal may be set purposefully.

It should be appreciated that embodiments of the driving method according to the present application further comprises: in the first phase, second phase, third phase and fourth phase, providing the first voltage signal to the first voltage terminal PVDD, and providing a second voltage signal to the second voltage terminal PVEE, wherein the voltage value of the first voltage signal is greater than the voltage value of the second voltage signal. Both the first voltage signal and second voltage signal are a signal having a constant voltage, the first voltage signal terminal of each pixel driving circuit in the organic light-emitting display panel may be connected to the same first voltage signal line, and the second voltage signal terminal of each pixel driving circuit may be connected to the same second voltage signal line.

Figure 8:
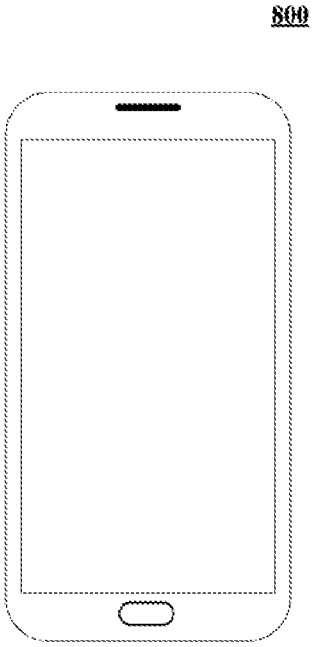
FIG. 8 is a schematic diagram of another display device according to the present application.

The present application further provides an organic light-emitting display device. As shown in FIG. 8, the organic light-emitting display device 800 includes the organic light-emitting display panel of the above embodiments, and may be a mobile phone, a tablet computer, a wearable device or the like. It may be appreciated that the organic light-emitting display device 800 may further include known structures such as an packaging film and protective glass, which will not be described in detail here.

What have been described above are only a few preferred embodiments of the present application and illustrations of the employed technical principles. Those skilled in the art should understand that the invention scope related to in the present application is not limited to technical solutions formed by specific combinations of the technical features above, which should also cover other technical solutions formed by any arbitrary combination of the technical features above or their equivalent features without departing from the inventive concept. For example, technical features formed by mutual substitution of the features above with technical features with similar functions disclosed in the present application (but not limited thereto).

What is claimed is:

1. An organic light-emitting display panel, comprising:

a plurality of pixel driving circuits arranged in a matrix, each of the pixel driving circuits comprising a first voltage terminal, a second voltage terminal, a scanning signal terminal, a data signal terminal, a first control signal terminal, a second control signal terminal, a potential collecting terminal, a driving module, an organic light-emitting device, a luminance control module, a data write module and a potential collecting module;

wherein the driving module comprises a first terminal, a second terminal and a control terminal, wherein the first terminal of the driving module is electrically connected with a first electrode of the organic light-emitting device, the second terminal of the driving module is electrically connected with the first voltage terminal, wherein the driving module is configured to drive the organic light-emitting device to emit light under control of the control terminal, based on a voltage provided by the first voltage terminal;

wherein a second electrode of the organic light-emitting device is electrically connected with the second voltage terminal;

wherein the luminance control module comprises a first terminal, a second terminal and a control terminal, the first terminal of the luminance control module is electrically connected with the first terminal of the driving module, the second terminal of the luminance control module is electrically connected with the control terminal of the driving module, the control terminal of the luminance control module is electrically connected with the first control signal terminal, and the luminance control module is configured to control luminance of the organic light-emitting device by controlling potentials of the first terminal and the control terminal of the driving module;

wherein the data write module is electrically connected with the scanning signal terminal, the control terminal of the driving module and the data signal terminal, and the data write module is configured to write a signal from the data signal terminal into the control terminal of the driving module under control of the scanning signal terminal; and wherein the potential collecting module is electrically connected with the second control signal terminal, the potential collecting terminal, and the first terminal of the driving module, and the potential collecting module is configured to collect the potential of the first terminal of the driving module, wherein the pixel driving circuit further comprises a reference voltage signal terminal, the luminance control module further includes a fourth transistor, a gate of the fourth transistor is electrically connected with the first control signal terminal, a first electrode of the fourth transistor is electrically connected with the reference voltage signal terminal, and a second electrode of the fourth transistor is directly connected with the first electrode of the driving transistor.

2. The organic light-emitting display panel according to claim 1, wherein the driving module comprises a driving transistor and a capacitor, both terminals of the capacitor are electrically connected with a gate and a first electrode of the driving transistor, respectively, the first electrode of the driving transistor is electrically connected with the first electrode of the organic light-emitting device, and a second electrode of the driving transistor is electrically connected with the first voltage terminal;

Wherein the luminance control module comprises a first transistor, a first electrode of the first transistor is electrically connected with the first electrode of the driving transistor, a second electrode of the first transistor is electrically connected with the gate of the driving transistor, and a gate of the first transistor is electrically connected with the first control signal terminal;

Wherein the data write module comprises a second transistor, a first electrode of the second transistor is electrically connected with the gate of the driving transistor, a second electrode of the second transistor is electrically connected with the data signal terminal, and a gate of the second transistor is electrically connected with the scanning signal terminal; and Wherein the potential collecting module comprises a third transistor, a first electrode of the third transistor is electrically connected with the first electrode of the driving transistor, a second electrode of the third transistor is electrically connected with the potential collecting terminal, and a gate of the third transistor is electrically connected with the second control signal terminal.

3. The organic light-emitting display panel according to claim 1, wherein the organic light-emitting display panel further comprises: a plurality of first control signal lines, a plurality of second control signal lines, a plurality of data lines, a plurality of scanning lines, a plurality of potential collecting lines, a first voltage signal line and a second voltage signal line;

wherein each of the first control signal lines is electrically connected with the first control signal terminals of one of the rows of the pixel driving circuits, wherein each of the second control signal lines is electrically connected with the second control signal terminals of one of the rows of the pixel driving circuits, wherein each of the data lines is electrically connected with the data signal terminals of one of the rows of the pixel driving circuits, wherein each of the scanning lines is electrically connected with the scanning signal terminals of one of the rows of the pixel driving circuits, and wherein each of the potential collecting lines is electrically connected with the potential collecting terminal; and wherein the first voltage terminal of each of the pixel driving circuits is electrically connected with the first voltage signal line, and the second voltage terminal of each of the pixel driving circuit is electrically connected with the second voltage signal line.

4. The organic light-emitting display panel according to claim 3, wherein the matrix of pixel driving circuits form a plurality of pairs of adjacent columns, each pair sharing one of the potential collecting lines.

5. The organic light-emitting display panel according to claim 1, further comprising at least one reference voltage signal line, wherein the at least one reference voltage signal line is electrically connected with the reference voltage signal terminals of at least two of the pixel driving circuits.

6. A driving method applied to the organic light-emitting display panel according to claim 1, wherein the driving method comprises:

in a first phase, providing a first level signal to the first control signal terminal, providing a second level signal to the second control signal terminal, and initializing the control terminal and first terminal of the driving module by the luminance control module to have an identical potential;

in a second phase, providing the first level signal to the scanning signal terminal, providing the second level signal to the first control signal terminal, providing the second level signal to the second control signal terminal, providing a first signal to the data signal terminal, writing the first signal into the control terminal of the driving module by the data write module, and charging the first terminal of the driving module by the first voltage terminal;

in a third phase, providing the second level signal to the first control signal terminal and the second control signal terminal, providing a data signal to the data signal terminal, and raising or lowering a potential of the control terminal of the driving module; and in a fourth phase, providing the first level signal to the scanning signal terminal and data signal terminal, providing a luminance control signal to the first control signal terminal, providing the second level signal to the second control signal terminal, emitting light by the organic light-emitting device according to a potential difference between the first terminal of the driving module and the control terminal of the driving module, controlling a light-emitting luminance of the organic light-emitting device with the luminance control signal by controlling light-emitting time of the organic light-emitting device.

7. The driving method according to claim 6, wherein the driving module further comprises a driving transistor and a capacitor, both terminals of the capacitor are electrically connected with a gate and a first electrode of the driving transistor, respectively, the first electrode of the driving transistor is electrically connected with the first electrode of the organic light-emitting device, a second electrode of the driving transistor is electrically connected with the first voltage terminal, the luminance control module comprises a first transistor, a first electrode of the first transistor is electrically connected with the first electrode of the driving transistor, a second electrode of the first transistor is electrically connected with the gate of the driving transistor, the gate of the first transistor is electrically connected with the first control signal terminal, the data write module comprises a second transistor, a first electrode of the second transistor is electrically connected with the gate of the driving transistor, a second electrode of the second transistor is electrically connected with the data signal terminal, a gate of the second transistor is electrically connected with the scanning signal terminal, the potential collecting module comprises a third transistor, a first electrode of the third transistor is electrically connected with the first electrode of the driving transistor, a second electrode of the third transistor is electrically connected with the potential collecting terminal, and a gate of the third transistor is electrically connected with the second control signal terminal;

wherein the driving method further comprises:

in the first phase, initializing the gate and the first electrode of the driving transistor by the luminance control module to have an identical potential;

in the second phase, writing the first signal into the gate of the driving transistor by the data write module, charging the first electrode of the driving transistor at the first voltage terminal, and storing a voltage between the gate and first electrode of the driving transistor at the capacitor;

in the third phase, changing a potential of the gate of the driving transistor; and in the fourth phase, emitting light at the organic light-emitting device according to a potential difference between the potential of the gate and the potential of the first electrode of the driving transistor.

8. The driving method according to claim 7, further comprising:

in the first phase, providing the first level signal to the scanning signal terminal, providing an initialization voltage signal to the data signal terminal, and transmitting the initialization voltage signal to the luminance control module by the data write module; and in the third phase, providing the first level signal to the scanning signal terminal, writing the data signal into the gate of the driving transistor by the data write module, and changing a signal of the gate of the driving transistor from the first signal to the data signal.

9. The driving method according to claim 8, wherein a voltage value of the initialization voltage signal is lower than a voltage value of the first signal; and Wherein a difference between the voltage value of the initialization voltage signal and the voltage value of a signal of the second voltage terminal is smaller than an ON voltage of the organic light-emitting device.

10. The driving method according to claim 7, wherein the pixel driving circuit further comprises a reference voltage signal terminal, the luminance control module further includes a fourth transistor, a gate of the fourth transistor is electrically connected with the first control signal terminal, a first electrode of the fourth transistor is electrically connected with the reference voltage signal terminal, and a second electrode of the fourth transistor is electrically connected with the first electrode of the driving transistor; and wherein the driving method further comprises:

in the first phase, providing the second level signal to the scanning signal terminal, providing the first signal to the data signal terminal, providing a reference voltage signal to the reference voltage signal terminal, and transmitting the reference voltage signal to the gate and first electrode of the driving transistor by the luminance control module; and in the third phase, providing the first level signal to the scanning signal terminal, and writing the data signal into the gate of the driving transistor by the data write module; and wherein a voltage value of the reference voltage signal is lower than an ON voltage of the organic light-emitting device.

11. The driving method according to claim 7, further comprising a threshold voltage obtaining phase prior to the first phase, wherein in the threshold voltage obtaining phase comprises providing the first level signal to the scanning signal terminal and the second control signal terminal, providing the second level signal to the first control signal terminal, providing a first signal to the data signal terminal, writing the first signal into the control terminal of the driving module by the data write module, and charging the first terminal of the driving module by the first voltage terminal.

12. The driving method according to claim 11, wherein the threshold voltage obtaining phase further comprises:

writing the first signal into the gate of the driving transistor by the data write module, charging the first electrode of the driving transistor by the first voltage terminal, storing a voltage between the gate and the first electrode of the driving transistor by the capacitor, and collecting a potential of the first electrode of the driving transistor by the potential collecting terminal.

13. The driving method according to claim 7, wherein a voltage value of the first signal is lower than a voltage value of the data signal.

14. The driving method according to claim 7, further comprising:

in the first phase, the second phase, the third phase and the fourth phase, providing the first voltage signal to the first voltage terminal, and providing the second voltage signal to the second voltage terminal, wherein a voltage value of the first voltage signal is larger than a voltage value of the second voltage signal.

15. An organic light-emitting display device, comprising the organic light-emitting display panel according to claim 1.

* * * * *